United States Patent [19]

Bando

[11] 4,079,551

[45] Mar. 21, 1978

[54] GLASS PLATE EDGE BEVELING MACHINE

[75] Inventor: Shigeru Bando, Tokushima, Japan

[73] Assignee: Bando Kiko Co., Ltd., Tokushima, Japan

[21] Appl. No.: 762,747

[22] Filed: Jan. 26, 1977

[51] Int. Cl.[2] ..... B24B 9/10

[52] U.S. Cl. ..... 51/110; 198/626

[58] Field of Search ..... 51/76 R, 110, 112, 137, 51/138, 215 E, 215 M; 198/626

[56] References Cited

U.S. PATENT DOCUMENTS

| | | | |
|---|---|---|---|
| 1,728,647 | 9/1929 | Weber | 51/110 |
| 2,598,190 | 5/1952 | Offutt | 51/215 E |
| 2,642,280 | 6/1953 | Fisk | 51/215 E |
| 2,754,956 | 7/1956 | Sommer | 51/110 X |
| 3,136,094 | 6/1964 | Reaser | 51/76 R |
| 3,841,027 | 10/1974 | Bando | 51/110 |

*Primary Examiner*—Harold D. Whitehead
*Assistant Examiner*—Nicholas P. Godici

[57] ABSTRACT

A glass plate edge beveling machine comprises a first chain conveyor mechanism provided with a supporting means, a second chain conveyor mechanism provided with a pressing means and a plurality of grinding means for beveling the lower end portion of a glass plate gripped between and transported by the supporting means and the pressing means, in which the supporting means comprises a plurality of unit members mounted on an endless chain and consisting of a base plate and a backing up plate, and on the surface of the backing up plate there is provided at least one projection raised toward the glass plate so that at least the lower portion of the glass plate is concavely curved.

2 Claims, 27 Drawing Figures

GLASS PLATE EDGE BEVELING MACHINE

The present invention relates to a glass plate edge beveling machine, for beveling the lower edge of a glass plate by means of a plural number of grinding wheels arranged in a series, with said glass plate being held between and transported by a supporting chain conveyor means comprising a plurality of connected rectangular unit members for supporting the glass plate and a pressing chain conveyor means adapted to move in synchronized relation with the supporting chain conveyor means, the former means being pressed against the latter means, and especially relates to an improvement of such a machine.

A conventional glass plate edge grinding machine is shown in FIG. 1. (This machine is one disclosed in U.S. Pat. No. 2,754,956.) In this conventional machine, a pair of holding units 11, 12 are adapted to transport a glass plate 13 with holding the glass plate therebetween. The lower end portion of a supporting conveyor means 11 of the holding conveyor unit for supporting the glass plate 13 is in contact with the lower end portion of the glass plate and opposed to a grinding wheel 15, while the lower end portion of the other means 12 is located above the grinding wheel 15. Each of the conveyor means 11, 12 are formed by attaching elastic members 16, 17 (of e.g. rubber or plastic material) onto the surfaces of the metal plates 18, 19 respectively so as not to do damage to the surface of the glass plate. Since the grinding wheel 15 is provided below the conveyor means 12 the width (i.e. vertical length) of the conveyor means 12 is smaller than that of the conveyor means 11 so that the conveyor means 12 contacts the glass plate in a smaller area than the conveyor means 11 and presses the glass plate. The lower end portion of the glass plate, which is in contact with the conveyor means 11 but not in contact with the conveyor means 12, is forced to be curved to project toward the grinding wheel 15 as shown in an imaginary line in FIG. 1.

When the lower end portion of the glass plate is curved, a gap 20 is formed between the said lower end portion of the glass plate and the conveyor means 11, and on applying grinding load in the direction of the arrow 21 onto the said lower end portion, the lower end portion moves toward the conveyor means 11. When the glass plate moves thus, the edge thereof cannot be uniformly beveled, to provide an unevenly beveled surface to the lower portion of the glass plate. As the grinding wheel is worn, the amount of such movement of the glass plate becomes larger, thus causing the beveled surface less even.

Further, in an apparatus of the abovementioned U.S. Pat. No. 2,754,956, the conveyor means 11 is regiliently pressed against the glass plate by means of a spring, so that the conveyor means 11 moves in the direction away from the conveyor means 12 under the grinding load, to provide uneven beveled surface to the glass plate similarly to the abovementioned case in which the glass plate moves away.

The main object of the present invention is to eliminate the abovementioned disadvantages especially by providing a glass plate edge beveling machine provided with a supporting conveyor means which can adequately supporting the lower end portion of a glass plate close to a grinding means.

To achieve this object, a supporting conveyor means and a pressing conveyor means are so adapted that a glass plate gripped and held therebetween is forced to be deformed into a desired curved shape by means of the pressing conveyor means, and that the lower end portion of the supporting conveyor means is brought in contact with the lower end portion of the said curved glass plate thereby perfectly eliminating the undesired movement of the lower end portion of the glass plate. Namely, as shown in FIG. 2, the lower end portion of the supporting conveyor means 25 is so formed as to project toward a grinding means 26 whereby the glass plate 13 in contact with the supporting conveyor means 25 as shown in an imaginary line is pressed by the pressing conveyor means 27 to be curved into such a shape as shown in a solid line. The lower end portion of the said curved glass plate is pressing the lower portion of the supporting conveyor means 25 with a strong restitution force. Since the said restitution force pressing the means 25 is balanced with the supporting force of the supporting conveyor means 25, and the lowermost portion of the glass plate is in contact with the supporting conveyor means 25, the glass plate is prevented from moving away even under the grinding load, whereby an evenly beveled surface can be provided throughout the whole length of the glass plate.

Other objects, features and advantages of the present invention will become apparent from the following description of embodiments of the present invention given with reference to the appended drawings, in which.

Figure 7:
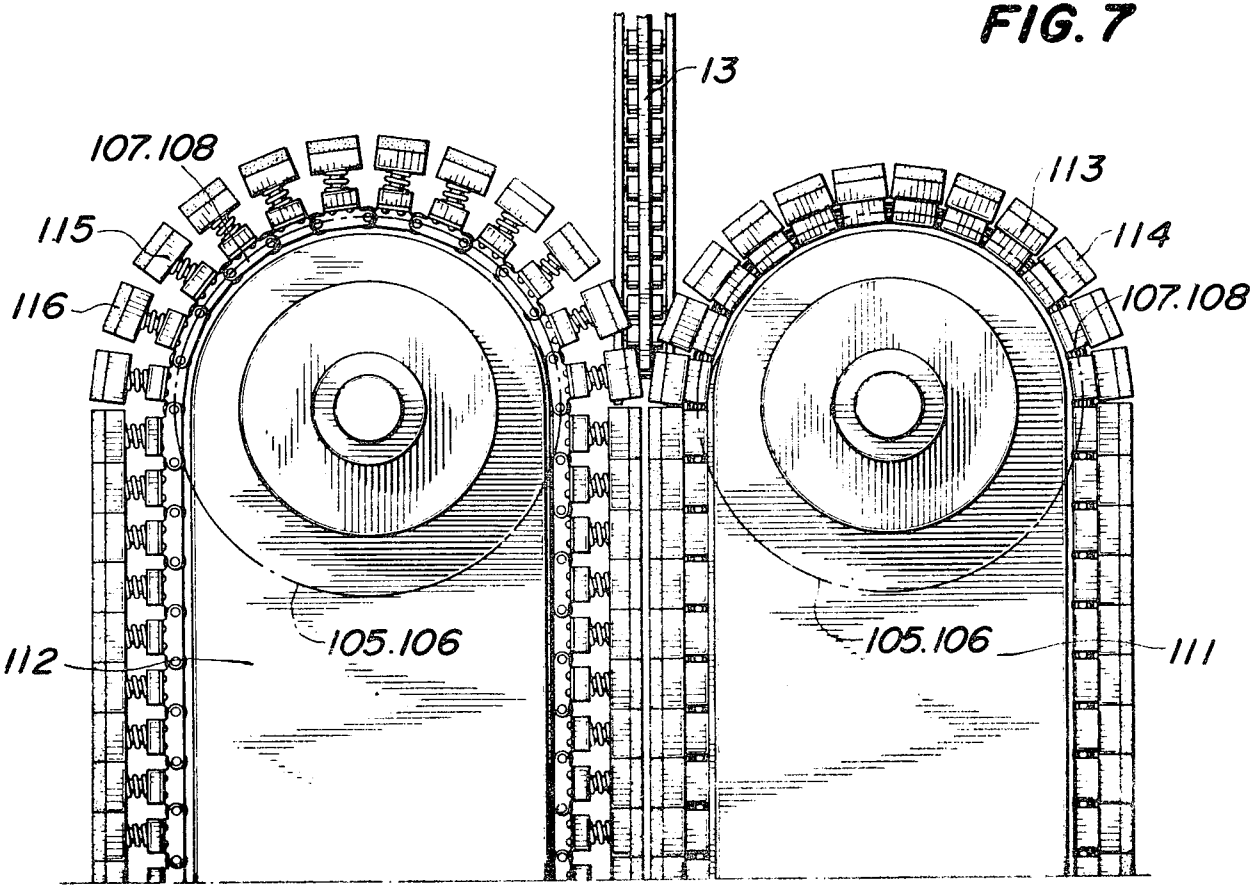

FIG. 7 is a plan view of a part of the second embodiment of the present invention; and FIGS. 8 to 27 are sectional views illustrating modifications of a backing-up plate of the unit member of the supporting means, FIGS. 8 to 17 illustrating the first form of backing-up plate in which the first part consisting of one element and the second part consisting of one or two elements are integrally formed, FIGS. 18 to 27 illustrating the second form in which the first part consisting of one element there is attached the second part consisting of one or two elements.

Figure 3:
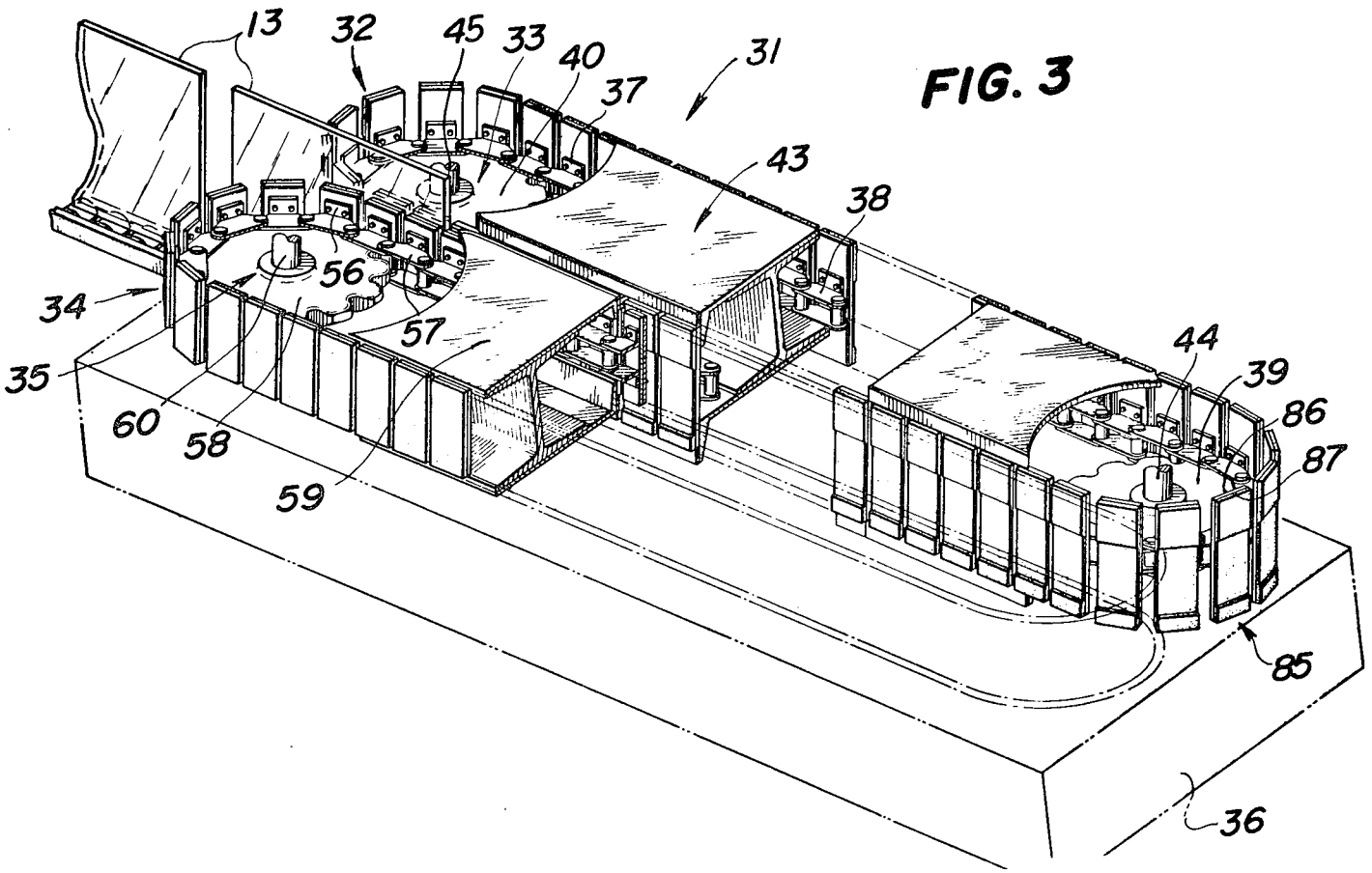
FIG. 3 is a perspective view of a first embodiment of a glass plate edge beveling machine according to the present invention in which a machine frame is removed away and a part of a second conveyor mechanism is cut away.
Figure 4:
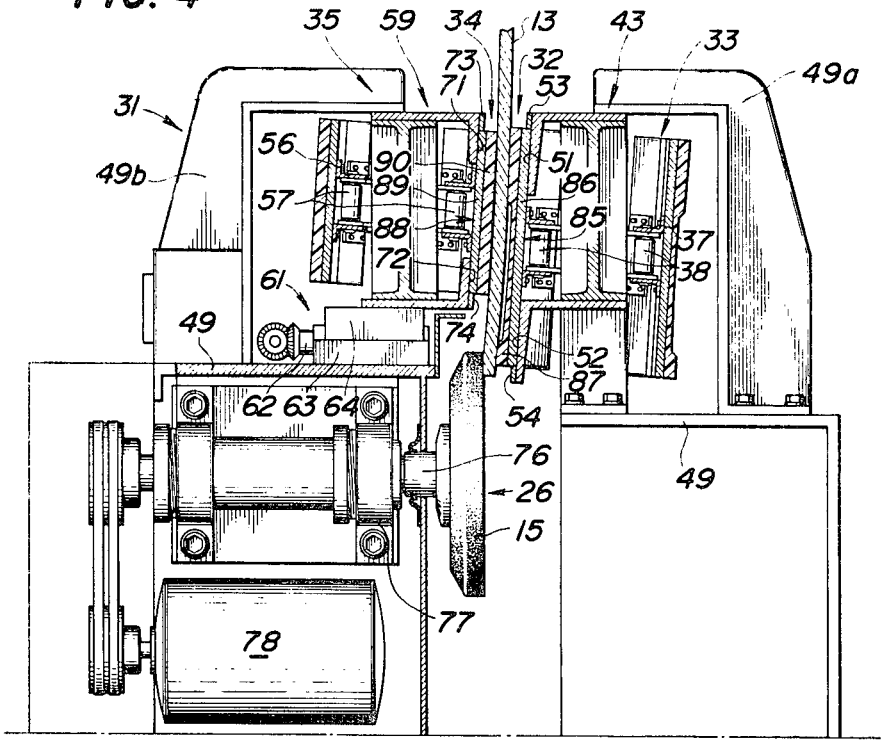
FIG. 4 is a vertical sectional view of the first embodiment of a machine according to the present invention.

FIGS. 3 and 4 illustrate the first embodiment 31 of a glass plate edge beveling machine according to the present invention. This machine 31 generally comprises a first conveyor mechanism 33 provided with a movable supporting means 32 adapted to contact one surface of a glass plate 13 to be worked, a second conveyor mechanism 35 provided with a pressing means 34 adapted to contact the other surface of the glass plate 13 to hold the glass plate 13 between the same and the supporting means 31 and the movable in synchronized relation with the supporting means 31, a driving means 36 for driving the first and second conveyor mechanisms, and a plurality of grinding means 26 arranged in a series on the side of the position of the pressing means with respect to the glass plate so as to bevel the lower end portion of the glass plate held between and transported by the supporting means 32 and the pressing means 34.

The first conveyor mechanism 33 comprises an endless chain 38, on which a plurality of equally spaced unit members of the supporting means 32 are mounted in such a manner that each unit member is attached to each pin link plate of the chain by means of a metal fixture 37, a pair of sprockets 39, 40 for driving the chain 38, and a guide frame 43 supporting the back surface of the supporting means 32 and providing the path of the supporting means 32, the sprockets 39, 40 being mounted on a driving shaft 44 and a driven shaft 45, respectively.

The guide frame 43 is disposed inside the endless chain 38 and between the pair of sprockets 39, 40 and fixed to a first frame 49a of a supporting frame 49 (shown only in FIG. 4). Further the guide frame 43 provides guide surfaces 51, 52 in contact with the back surface of the supporting means 32 as shown in FIG. 3. Numerals 53, 54 indicate guide plates provided on the guide surfaces 51, 52. These upper and lower guide plates 53, 54 together with the guide surfaces 51, 52 define the path for the supporting means 32.

The second conveyor mechanism 35 comprises an endless chain 57 on which a plurality of equally spaced unit members of the pressing means are mounted in such a manner that each unit member is attached to each pin link plate of the chain 57 by means of a metal fixture 56, a pair of sprockets 58 (one of them not shown in FIG. 3) for driving the chain 57, and a guide frame 59 supporting the back surface of the pressing means 34 and providing the path for the pressing means 34, said pair of sprockets 58 being mounted on a driving shaft (not shown) and a driven shaft 60 respectively of a driving mechanism 36.

The chain 57, the sprockets 58, the guide frame 59 and the shaft 60 of the second conveyor mechanism 35 have similar construction to those of the first conveyor mechanism 33 respectively. However, the guide frame 59 is not fixed to a second frame 49b of the supporting frame 49 but mounted on a sliding means 61 so that the guide frame 59 is movable in the direction at right angles with the direction of the glass plate feeding. The sliding means 61 (shown only in FIG. 4) of the second conveyor mechanism 35 comprises a screw shaft 62 adapted to be rotated through a pair of bevel gears by the driving mechanism 36, a holder 63 fixed to the supporting frame 49 so as to rotatably hold the screw shaft 62, and a slider 64 slidably supported by the holder 63, on the upper surface of which the guide frame 59 is mounted. This sliding means 61 is adapted to move the guide frame 59 perpendicularly to the direction of the glass plate feeding by rotating the screw shaft 62 to adjust the distance of the frame 59 from the guide frame 43 in correspondence with the thickness of the glass plate gripped between the supporting means and the pressing means. That is, the guide frame 59 is slidable to adjust the said distance between the guide frames 59, 43 so that the supporting means and the pressing means can move with gripping the glass plate in such a curved state as to project toward the supporting means. Further, since the tension of the endless chain 57 somewhat changes as the guide frame 59 moves, the second conveyor mechanism is preferably provided with a means for adjusting the tension. The guide frame 59 provides guide surfaces 71, 72 in contact with the pressing means 34. Guide plates 73, 74 are provided on the upper portion of the guide surface 71 and the lower portion of the guide surface 72 respectively. Therefore, the guide surfaces 71, 72 together with the guide plates 73, 74 define the path for the pressing means.

The lower edge of the path for the pressing means is situated above the lower edge of the path of the supporting means so that the grinding wheel 15 of the grinding means 26 disposed below the pressing means is prevented from contacting the pressing means, the lower guide plate 74 and the like.

In the grinding means 26, a spindle 76 equipped with the grinding wheel 15 at one end thereof is rotatably supported through a bearing 77 and rotated by means of a motor 78. In a glass plate edge beveling machine, generally, the glass plate edge beveled by the grinding wheel is then lapped on the beveled surface and finished by buffing the surface.

Figure 1:
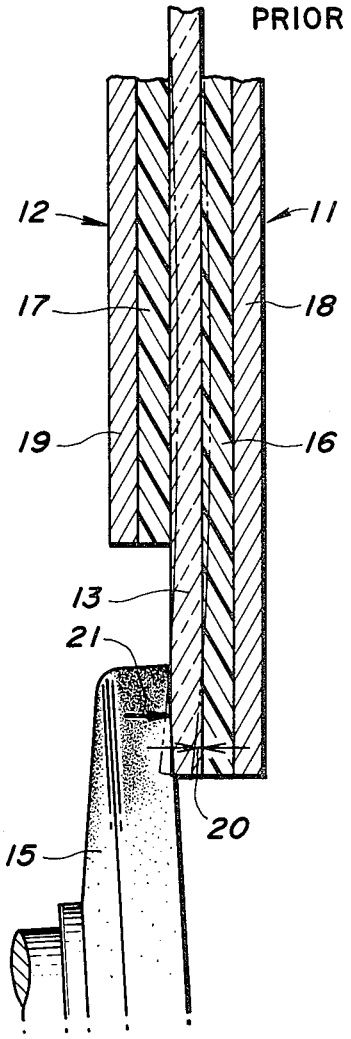
FIG. 1 PRIOR ART
FIG. 1 is an explanatory sectional view of a chain conveyor unit for holding and transporting a glass plate of a conventional glass plate edge beveling machine.
Figure 2:
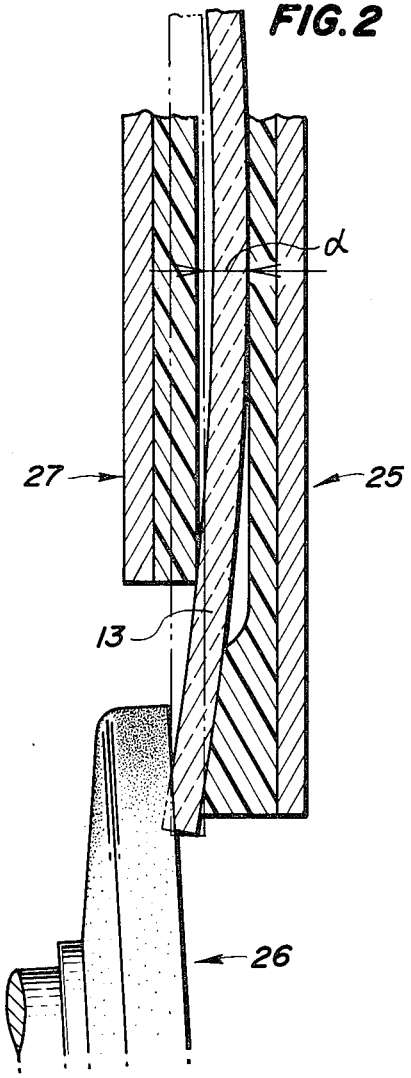
FIG. 2 is an explanatory sectional view of a chain conveyor unit according to the present invention.

In the machine as shown in FIG. 4, the grinding surface of the grinding wheel 15 is disposed vertically and the glass plate to be beveled is fed so as to be slightly inclined with respect to a vertical plane. On the contrary, however, the glass plate may be fed vertically as shown in FIG. 2 while the grinding wheel is inclined with respect thereto for permitting beveling operation. A unit member 85 of the supporting means 32 used in the glass plate edge beveling machine 31 in FIGS. 3 and 4 is shown in perspective view in FIG. 5, and comprises a flat metal base plate 86 and a concavely curved backing up plate 87 adhered to the base plate 86.

The backing up plate 87 is provided with projections $A_1$, $A_2$ on the lower and upper portions thereof respectively raised beyond the level of the middle portion comprising a flat portion B. Each of the lower and upper projections $A_1$, $A_2$ is provided with a curved surface $D_1$ or $D_2$. The backing up plate 87 is formed by integrally molding the flat plate providing the flat portion B with the lower and upper projections $A_1$, $A_2$ or by adhering the projections $A_1$, $A_2$ onto the flat plate, so that the projections $A_1$, $A_2$ are disposed nearer to a glass plate to be worked than the flat portion B. The lower projection $A_1$ is adapted to contact the glass plate portion adjacent to the grinding wheel, and it is the most preferable for supporting the lower end portion of the glass plate subject to grinding load that the lower projection $A_1$ is disposed in opposition to the grinding wheel with the interposition of the glass plate therebetween. The surface of the lower projection $A_1$ is in the form of the curved surface $D_1$ so that it comes in surface-contact with one surface of the glass plate which is suitably curved by means of the pressing means 34. The upper projection $A_2$ is provided with the curved surface $D_2$ similarly to the lower projection. The vertical length (i.e. length at right angles with the direction of the movement of the unit member) of the projection $A_2$ is larger than that of the lower projection $A_1$ so that a glass plate smaller in vertical length than the unit member can be supported thereby.

The middle flat portion B is adapted to face the protruded portion of the curved glass plate. The height of the projections $A_1$, $A_2$ are so selected as to permit the middle flat portion B to contact the glass plate, but the glass plate can be surely gripped and supported even if the portion B is not in contact the same.

The backing up plate 87 is formed of rigid synthetic resin, natural or synthetic rubber, unwoven cloth or other material which preferably has elasticity as well as stiffness durable against compression. The minimum requirement for the material of the backing up plate is not to do damage to the glass plate in contact therewith. Any other material than the abovementioned can be used if it meets with the requirement.

A unit member 88 of the pressing means 34 shown in FIGS. 3 and 4 comprises a base plate 89 and a backing up plate 90. The base plate 89 is in the form of a metal flat plate of a length(length at right angles with the direction of the glass plate feeding) is somewhat shorter than that of the abovementioned base plate 86 in FIG. 5. The backing up plate 90 is in the form of a flat plate i.e. having even surfaces, formed possibly of a material similar to that of the backing up plate 87 and adhered to the base plate 89 by means of adhesive agent. However, since the backing up plates 87 and 90 have to grip the glass plate therebetween, either of them is preferably formed of an elastic material.

The unit members 85, 88 of the abovementioned construction are adapted to move at the same speed in such a manner that a glass plate 13 is gripped between a pair or pairs of unit members. Correct opposition of a pair of unit members with each other is not necessarily required for gripping and deforming a glass plate, but the pair of unit members are preferably moved in a correctly opposed state for properly achieving this purpose.

These unit members deform the glass plate gripped therebetween in a suitable amount of deformation which is limited by the maximum distance of the displacement of the glass plate portion to be deformed from the flat state into the curved state (distance $\alpha$ in FIG. 2). And each backing up plate of the unit members of the supporting means is so adapted as to obtain such a suitable amount of glass plate deformation. The said deformation amount $\alpha$ is within a range not causing breakage of the glass plate, i.e. 0.1 – 0.7mm, preferably about 0.25 – 0.4mm.

Figure 6:
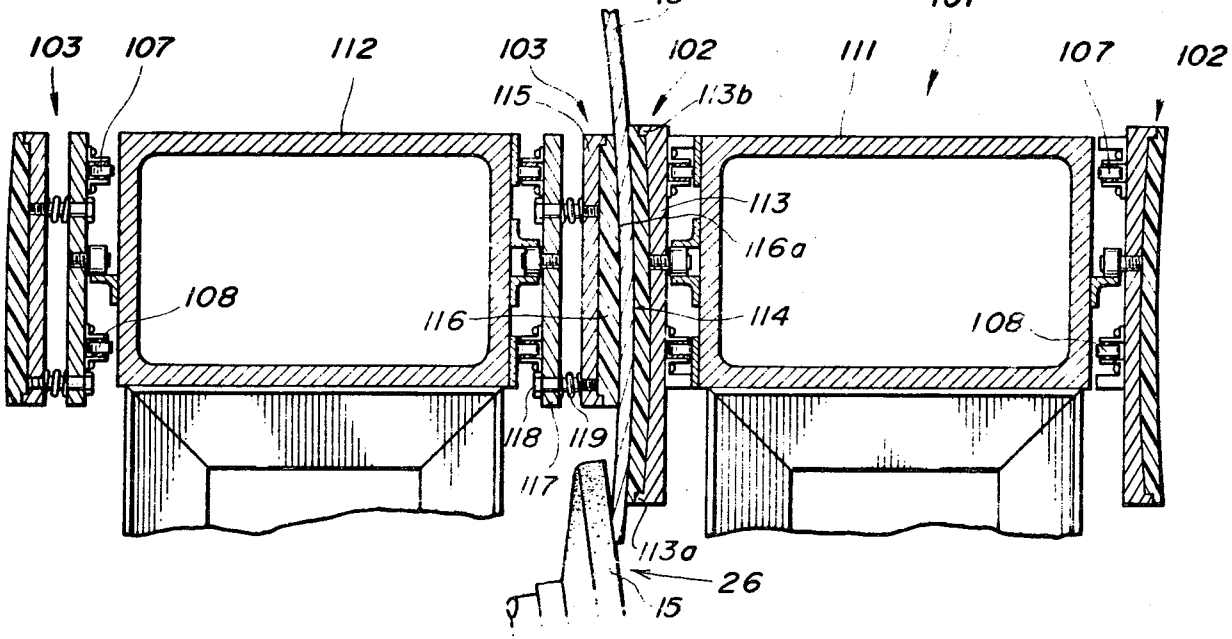
FIG. 6 is a vertical sectional view of a second embodiment of a machine according to the present invention.

FIGS. 6, 7 illustrate the second embodiment of the present invention, in which a glass plate edge beveling machine 101 is the same with the abovementioned machine disclosed in U.S. Pat. No. 2,754,956 except the shape of a pair of endless conveyor units 102, 103 and the position of a grinding spindle assembly 26. That is, the machine 101 is obtained by improving the conventional machine only in its endless conveyor unit.

The machine 101 comprises a supporting means 102 and a pressing means 103 adapted to grip a glass plate therebetween and mounted on two endless chains 107, 108 respectively driven by two pairs of sprokets 105, 106, the movement of each of the supporting means 102 and the pressing means 103 being guided by an elongated stationary guide member 111 or 112. Each unit member of the supporting means 102 comprises a base plate 113 and a backing up plate 114, while each unit member of the pressing means 103 comprises a base plate 115, a backing up plate 116, a mounted plate 117 fixed to the endless chains 107, 108, screws 118 and spring 119. Thus, the pressing means 103 resiliently urges the backing up plate 116 against the glass plate by means of the spring 119. The surface of the base plate 113 to be adhered to the backing up plate 114 is formed in a curved shape and provided with projections 113*a*, 113*b* at the upper and lower end portions thereof. The backing up plate 114 comprises a single flat plate and is provided on its surface close to the base plate 113 with recesses for engagement with the projections 113*a*, 113*b*. With the engagement between the projections and the recesses, the base plate and the backing up plate in the unit member of the means 102 can be more firmly connected than in the unit member of the means 32. Since the backing up plate 114 is adhered to the curved surface of the base plate 113, the surface of the unit member of the supporting means 102 to contact the glass plate is also curved, thereby permitting the glass plate to be curved when pressed by the pressing means.

In the unit member of the pressing means 103, similarly to that of the supporting means 102, the base plate 115 and the backing up plate 116 are firmly connected through the engagement between projections on the former and recesses in the latter. And the backing up plate 116 is provided with a curved surface projecting toward the glass plate so as to surface-contact with the surface of the glass plate curved when pressed. Further, this curved surface 116*a* serves for deforming the glass plate in a predetermined shape (at a predetermined curvature) when pressing the same. By beveling the edge of the glass plate gripped and deformed between the supporting means and the pressing means as shown in FIG. 4 or 6, restitution force acting throughout the glass plate causes the lower end portion of the glass plate to urge the lower end portion of the unit member of the pressing means without providing a gap between each of the lower end portions of the unit members of the supporting and pressing means and the glass plate. Therefore, the lower end portion of the glass plate does not move away when grinding load is applied thereto, thereby providing an evenly beveled surface.

FIGS. 8 to 27 illustrate modifications of the backing up plate of the unit member of the supporting means 2 to be used in the machine shown in FIG. 4 or 6. In each of the first form of backing up plates 121 to 130 shown in FIGS. 8 to 17, the first part consisting of one element and the second part consisting of one or two elements are integrally molded while in each of the second form of backing up plates 121 to 130 shown in FIGS. 18 to 27, on the first part consisting of one element separate one or two elements for the second part are adhered or fused. That is, the corresponding first and second forms of the backing up plates are different only in the method for manufacturing, and have the same appearance when finished.

Further, each of the backing up plates in FIGS. 8 to 12 and 18 to 22 is provided with a projection only at the lower end thereof, and those in FIGS. 13 to 17 and 23 to 27 with projections both at the upper and lower ends.

Figure 8:
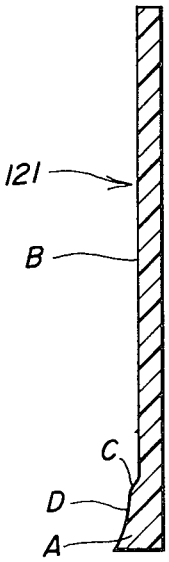
Figure 18:
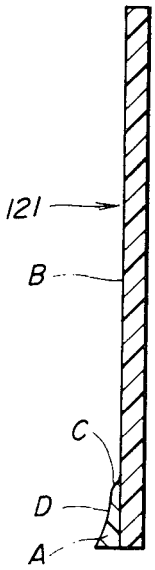

In the backing up plate 121 shown in each of FIGS. 8 and 18, a projection i.e. second part A with a surface D is provided so as to be raised throughout the lower end portion of the surface of the backing up plate close to the glass plate. And the remaining part of the said surface of the backing up plate is a flat and even surface provided by the first part B which is a flat plate. The surface of the backing up plate 121 continues from the flat surface of the other portion than the lower end portion of the first part B through a rounded corner C to the surface D of the second part A.

This surface D of the second part A is gradually curved so as to correspond to the glass plate surface caused to be curved by the backing up plate. Not whole of the curved surface D of the projection i.e. second part A has to contact the glass plate surface, but at least the lower end portion thereof has to.

Figure 13:
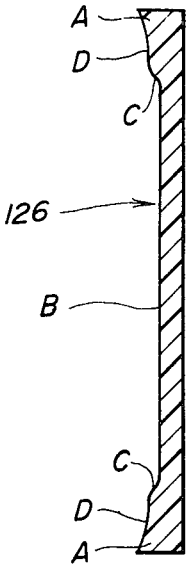
Figure 23:
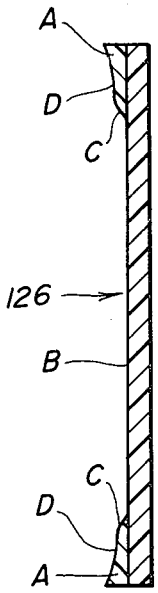

In each of the backing up plates 126 shown in FIGS. 13 and 23, the second parts A are provided at the upper and lower end portions thereof with the interposition of a flat and even surface of the second part B therebetween. The two second parts A are the same in vertical length.

Figure 5:
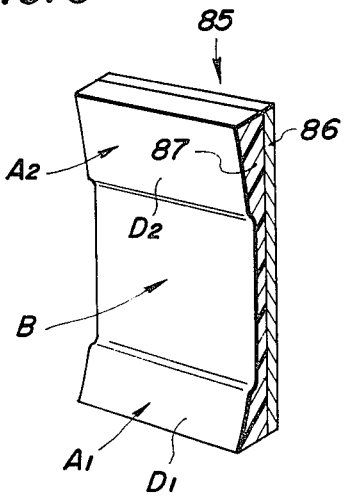
FIG. 5 is a perspective view of a unit member of a supporting means used in the first emboidment of the machine of the present invention.

The curved surface D of the projection i.e. second part of each of the backing up plates 121, 126 are of the same with the curved surface $D_1$ of the backing up plate 87 shown in FIG. 5.

Figure 9:
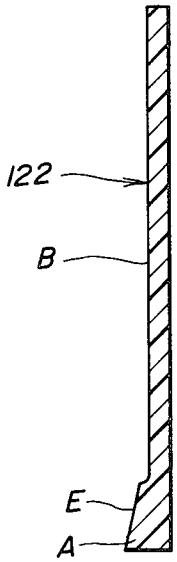
Figure 19:
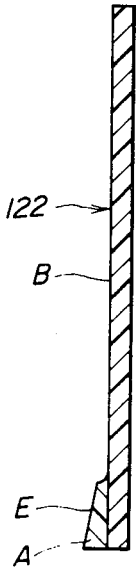

In each of the backing up plates 122 shown in FIGS. 9 and 19, there is provided an angled projection i.e. second part A throughout the lower end portion of the surface of the backing up plate close to the glass plate, and the other part of the said surface of the backing up plate than that of the projection is even and flat surface provided by the first part B which is a flat plate. The surface E of the projection i.e. second part A is flat and even, but the height of the projection is smaller in its portion adjacent to the middle portion of the backing up plate than its portion adjacent to the lower end thereof, thus providing a flat surface downwardly inclined toward the middle portion of the backing up plate.

Figure 14:
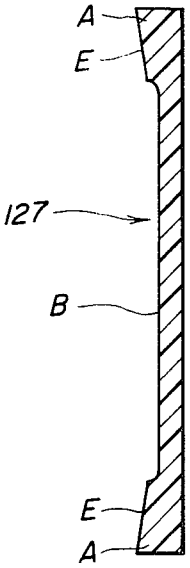
Figure 24:
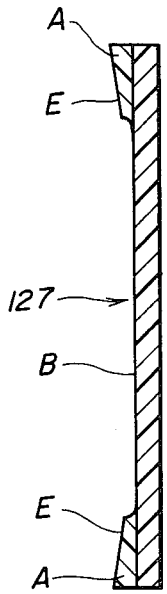

In each of the backing up plates 127 shown in FIGS. 14 and 24, there are provided two second parts A each with a surface E at the upper and lower end portions of the backing up plate with a flat surface therebetween provided by the flat plate i.e. first part B, said flat surface being to face the glass plate.

Figure 10:
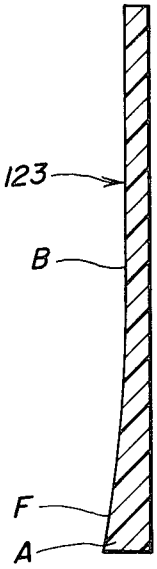
Figure 20:
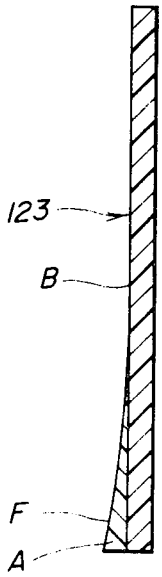

In each of the backing up plates 123 shown in FIGS. 10 and 20, there is provided a curved projection i.e. the second part A with a surface F gradually raised throughout i.e. from the upper end to the lower end of the lower end portion of the backing up plate, the remaining part of the surface of the backing up plate close to the glass plate is a flat surface provided by the first part B which is a flat plate. The second part A is raised toward the lower edge of the backing up plate so gently that the boundary between the first and second parts is substantially inappreciable. Similarly to the surface D of the backing up plate 121, the curved surface F of the projection A is formed at such a curvature as to permit a surface F thereof to contact the surface of the glass plate curved by the pressing means.

Figure 15:
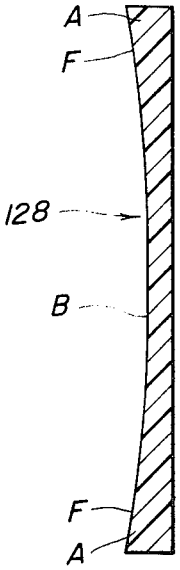
Figure 25:
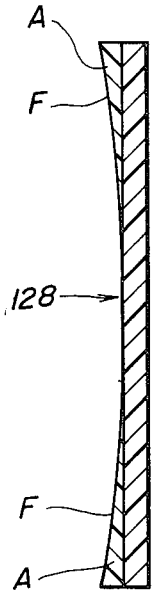

In each of the backing up plates 128 shown in FIGS. 15 and 25, there are provided two second parts i.e. projections A each with the curved surface F on the upper and lower portions of the backing up plate with a flat surface therebetween provided by the first part B which is a flat plate.

The upper and lower second parts A of the backing up plate 128 may be extended to the middle of the backing up plate so as to permit the curved surface F to expand over the whole surface of the backing up plate. Then, the contact line between the two second parts A coincides with the surface of the first part B, and the surface of the backing up plate 128 close to the glass plate is the same with that of the backing up plate 114 in FIG. 6.

Figure 11:
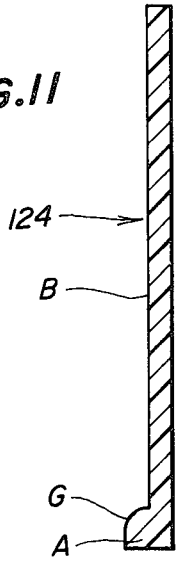
Figure 21:
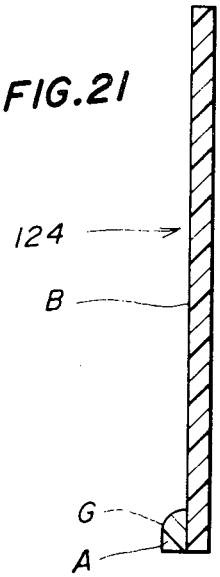

In each of the backing up plates 124 shown in FIGS. 11 and 21, there is provided a projection A with an arched surface G protruding toward the glass plate at the lower end of the lower end portion of the surface of the backing up plate close to the glass plate. The other surface than that of the projection is a flat surface provided by the first part B which is a flat plate. The projection A is adapted to line-contact the glass plate.

Figure 16:
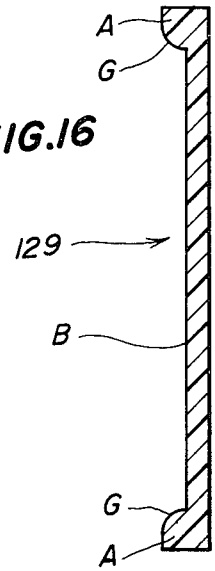
Figure 26:
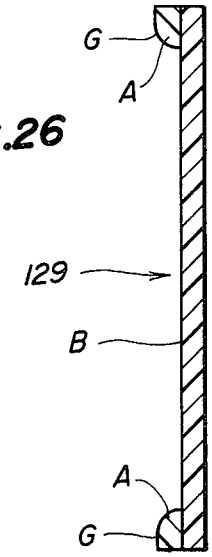

In each of the backing up plates 129 shown in FIGS. 16 and 26, there are provided two projections A i.e. second parts each with an arched surface G on the uppermost and lowermost ends of the backing up plate with the interposition therebetween of a flat surface provided by the first part B which is a flat plate.

Figure 12:
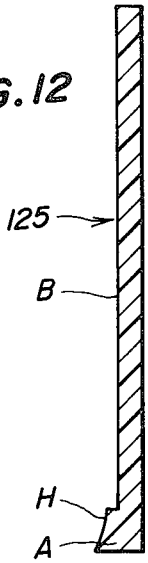
Figure 22:
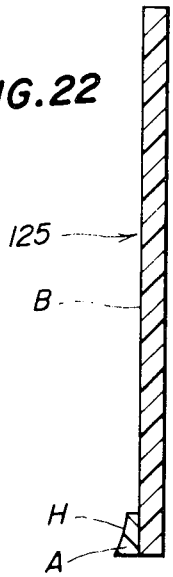

In each of the backing up plates 125 shown in FIGS. 12 and 22, there is provided a projection A with a concave surface H at the lowermost end of the backing up plate. The other surface of the backing up plate than that of the projection is a flat surface provided by the first part B which is a flat plate. The projection A is adapted to surface-contact with the glass plate curved.

Figure 17:
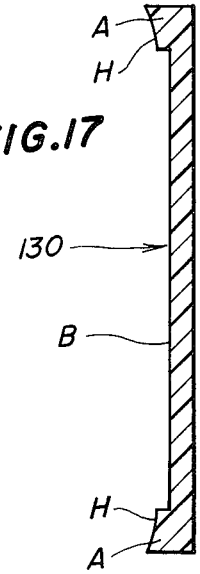
Figure 27:
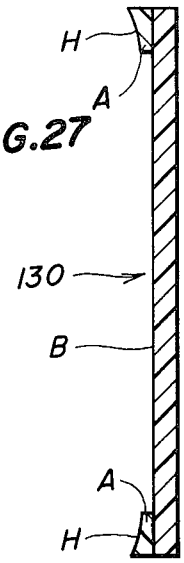

In each of the backing up plates 130 shown in FIGS. 17 and 27, there are provided two second parts i.e. projections A each with a concave surface H at the uppermost and lowermost ends of the backing up plate, with the interposition of a flat surface therebetween provided by the first part B which is a flat plate.

Though backing up plates are all shown only in sectional view in FIGS. 7 to 27, each projection thereof is extended throughout the whole length (in the direction of the movement thereof) so as to cover a strip of the end portion of the surface of the backing up plate, similarly to that of the plate 87 in FIG. 5.

Further, the upper projection of each of the backing up plates in FIGS. 14 and 24 may be extended downwardly to form a larger width (i.e. vertical length) of projection similar to the projection $A_2$ in FIG. 5 so as to be applied in beveling small width (i.e. vertical length) of glass plates.

Similarly to the backing up plates 87, 114, the backing up plates 121 to 130 can hold the glass plate so that the glass plate curved with deformation amount of about 0.1 - 0.7mm are regularly beveled.

What is claimed is:

1. In a glass plate edge beveling machine having supporting means having a plurality of unit members mounted on an endless chain and adapted to contact one side of a glass plate, pressing means having a plurality of unit members mounted on another endless chain and adapted to contact the other side of the glass plate for pressing the glass plate against the supporting means, means for moving said endless chains to transport a glass plate held between said supporting means and said pressing means, and grinding means below the pressing means for beveling the end portion of the glass plate, each of the unit members of the supporting means and each of the unit members of the pressing means having a top and a bottom, the length of the unit members of the supporting means from top to bottom being longer than the length of the unit members of the pressing means and the bottom portions of the unit members of the supporting means extending below the bottoms of the unit members of the pressing means, each of the unit members of both the supporting means and the pressing means including a backing up plate adapted to contact the glass plate and a base plate, the improvement characterized in that the bottom portion of each of the backing up plates of the supporting means below the bottom of the pressing means is thicker than the portion of the backing plate above the bottom of the pressing means and projects closer to the plane of the pressing means than the portion of the backing plate above the bottom of the pressing means whereby the bottom portion of a glass plate held between the supporting means and the pressing means is curved toward the grinding means.

2. In a glass plate edge beveling machine having supporting means having a plurality of unit members mounted on an endless chain and adapted to contact one side of a glass plate, pressing means having a plurality of unit members mounted on another endless chain and adapted to contact the other side of the glass plate for pressing the glass plate against the supporting means, means for moving said endless chains to transport a glass plate held between said supporting means and said pressing means, and grinding means below the pressing means for beveling the end portion of the glass plate, each of the unit members of the supporting means and each of the unit members of the pressing means having a top and a bottom, the length of the unit members of the supporting means from top to bottom being longer than the length of the unit members of the pressing means and the bottom portions of the unit members of the supporting means extending below the bottoms of the unit members of the pressing means, each of the unit members of both the supporting means and the pressing means including a backing up plate adapted to contact the glass plate and a base plate, the improvement characterized in that the bottom portion of each of the base plates of the supporting means below the bottom of the pressing means is thicker than the portion of the base plate above the bottom of the pressing means and projects closer to the plane of the pressing means than the portion of the base plate above the bottom of the pressing means whereby the bottom portion of the glass plate held between the supporting means and the pressing means is curved toward the grinding means.

* * * * *